US008672650B2

(12) United States Patent
Horng et al.

(10) Patent No.: US 8,672,650 B2
(45) Date of Patent: Mar. 18, 2014

(54) COOLING FAN

(75) Inventors: Alex Horng, Kaohsiung (TW); Ko-Chien Wang, Kaohsiung (TW); Yeh-Feng Chen, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 159 days.

(21) Appl. No.: 13/031,648

(22) Filed: Feb. 22, 2011

(65) Prior Publication Data

US 2012/0114511 A1 May 10, 2012

(30) Foreign Application Priority Data

Nov. 8, 2010 (TW) ..... 99138330 A
Jan. 10, 2011 (TW) ..... 100100778 A

(51) Int. Cl.
*F04B 35/04* (2006.01)
*F04B 17/00* (2006.01)
*F04D 29/44* (2006.01)
*F04D 29/54* (2006.01)

(52) U.S. Cl.
USPC ..... 417/423.1; 417/410.1; 415/203; 415/205

(58) Field of Classification Search
USPC ..... 417/423.1, 423.7, 423.9, 423.14; 415/203, 204, 205, 53.1, 54.1
See application file for complete search history.

(56) References Cited

U.S. PATENT DOCUMENTS 3,274,410 A * 9/1966 Ivan ..... 310/62
4,164,690 A * 8/1979 Muller et al. ..... 318/400.41
5,879,141 A * 3/1999 Yokozawa et al. ..... 417/423.7
6,210,101 B1 4/2001 Horng
6,652,223 B1 * 11/2003 Horng et al. ..... 415/53.1
7,201,565 B2 4/2007 Ku et al.
7,255,532 B2 * 8/2007 Zheng ..... 415/183
7,481,613 B2 1/2009 Hong et al.
7,492,587 B2 * 2/2009 Chang ..... 361/679.44
2004/0096326 A1 * 5/2004 Chang et al. ..... 415/220
2007/0041857 A1 * 2/2007 Fleig ..... 417/423.14

(Continued)

FOREIGN PATENT DOCUMENTS

CN 2505630 Y 8/2002
CN 102465894 A 5/2012

(Continued)

*Primary Examiner* — Devon Kramer
*Assistant Examiner* — Lilya Pekarskaya
(74) *Attorney, Agent, or Firm* — Alan Kamrath; Kamrath IP Lawfirm, P.A.

(57) ABSTRACT

A cooling fan includes a housing and a motor. The housing includes a support portion, a cover portion and a lateral wall portion. The lateral wall portion is disposed between the cover portion and the support portion, and the lateral wall portion, support portion and the cover portion define a compartment, with the lateral wall portion having at least one lateral air inlet and at least one lateral air outlet penetrating through the lateral wall portion and communicating with the compartment. The motor is mounted inside the compartment of the housing and contains a stator and a impeller, with the impeller rotatably mounting to the stator. The motor further contains a hub with a top and a plurality of blades, with the top facing the cover portion, with the top and the cover portion delimiting a lateral flow path in the compartment, and with each blade being contained in the lateral flow path.

16 Claims, 10 Drawing Sheets

(56) References Cited

U.S. PATENT DOCUMENTS

| | | | | |
|---|---|---|---|---|
| 2007/0166177 | A1 | 7/2007 | Lopatinsky et al. | |
| 2008/0149306 | A1 | 6/2008 | Hwang et al. | |
| 2009/0060738 | A1 | 3/2009 | Chen et al. | |
| 2010/0104421 | A1* | 4/2010 | Hwang et al. | 415/119 |
| 2010/0290923 | A1* | 11/2010 | Liu | 417/63 |

FOREIGN PATENT DOCUMENTS

| | | | |
|---|---|---|---|
| DE | 4023261 | A1 | 2/1991 |
| JP | 2003-307198 | A | 10/2003 |
| KR | 200205488 | Y1 | 12/2000 |
| TW | 553323 | | 9/2003 |

* cited by examiner

COOLING FAN

BACKGROUND OF THE INVENTION

1. Field of the Invention

The present invention relates to a cooling fan and, more particularly, to a cooling fan that can conduct air currents to flow in and to flow out through a radial direction of an impeller.

2. Description of the Related Art

Conventional cooling fans are mainly divided into two types: axial-flow type and blower type. Each cooling fan of the axial-flow type has an axial air inlet and an axial air outlet thereof opposite to each other in the axial direction, which can conduct airflows directly flowing in and flowing out via the axial air inlet and the axial air outlet to dissipate heat. On the other hand, each cooling fan of the blower type has an axial air inlet in the axial direction, and a radial air outlet in the radial direction thereof, which can dissipate heat by inhaling air through the axial air inlet and sequentially exhaling air via the radial air outlet.

However, cooling fans of the axial-flow type can not provide radial heat-dissipation, because there is no passageway of airflows in the radial direction. Therefore, cooling fans of the axial-flow type have to be disposed on the heat source, for example, at the top of the central processor of a personal computer, when it is practically used in any electric equipment. In this situation, the axial height of the electric equipment needs to be maintained at a proper range for the axial-flow cooling fan to be axially mounted on the heat source, which leads to difficulty in axial miniaturization of the electric equipment. Yet, cooling fans of the blower type are not suitable for using in electric equipments that only allow for radial airflow-circuit, such as mobile phones and personal digital assistants, due to the allocations of the axial air inlet in cooling fans of the blower type.

Accordingly, the other type of conventional cooling fan, capable of inhaling and exhaling air flowing in a radial direction of an impeller, is designed in order to adapt to electric equipments that only allow for radial airflow. As shown in FIG. 1, a first conventional cooling fan 8 disclosed in Taiwan Patent No. 553323 and entitled "FAN STRUCTURE HAVING HORIZONTAL CONVECTION" comprises a housing 81 and an impeller 82. The housing 81 has at least one air inlet 811 and at least one air outlet 812, with a horizontal air-passageway 813 defined between the air inlet 811 and the air outlet 812. The impeller 82 is mounted inside the horizontal air-passageway 813 and comprises a hub 821 and a plurality of blades 822 mounted to the peripheral surface thereof. Accordingly, the difference in air pressure between the air inlet 811 and the air outlet 812, generated by the rotating impeller 82, can facilitate the heat-dissipation by driving air currents flowing from the air inlet 811 through the horizontal air-passageway 813 to the air outlet 812.

However, when the airflows are conducted by the plurality of blades 822 of the impeller 82 and pass through the horizontal air-passageway 813 for air convection, the hub 821 easily disturbs the airflows as well as generates air turbulence due to the location of the hub 821. Hence, the cooling efficiency of the conventional cooling fan 8 is limited.

Also, another conventional cooling fan 9 is described in Taiwan Patent No. 477492, entitled "CONNECTION OF BLOWER FAN" and shown in FIG. 2, comprising a rotor seat 91, an impeller 92 and a housing 93. The rotor seat 91 has a plurality of blocks 911, and the impeller 92 has a plurality of holes 921, with the plurality of blocks 911 respectively coupled to the plurality of holes 921. The housing 93 is used for containing the rotor seat 91 and the impeller 92, and the housing 93 has an air inlet 931 and an air outlet 932. In this way, the rotating impeller 92 propels airflows radially flowing into the housing 93 from the air inlet 931 and sequentially flowing out from the air outlet 932 for heat-dissipation.

Nevertheless, the rotor seat 91 and the impeller 92 are both located in the air passageway between the air inlet 931 and the air outlet 932, which causes air turbulences to easily happen to the airflows conducted by the impeller 92 because of the disturbance of the rotor seat 91. Also, an additional step to assemble the impeller 92 and the rotor seat 91 need to be executed before they are inserted into the housing 93, so that the fabrication of the conventional cooling fan 9 is inconvenient and troublesome.

SUMMARY OF THE INVENTION

The primary objective of this invention is to provide a cooling fan whose impeller can effectively prevent air disturbances when it conducts airflows to radially flow in and radially flow out.

A cooling fan including a housing and a motor is presented. The housing includes a support portion, a cover portion and a lateral wall portion. The lateral wall portion is disposed between the cover portion and the support portion, and the lateral wall portion, support portion and the cover portion define a compartment, with the lateral wall portion having at least one lateral air inlet and at least one lateral air outlet penetrating through the lateral wall portion and communicating with the compartment. The motor is mounted inside the compartment of the housing and contains a stator and an impeller, with the impeller rotatably mounting to the stator. The motor further contains a hub with a top and a plurality of blades, with the top facing the cover portion, with the top and the cover portion delimiting a lateral flow path in the compartment, and with each blade being contained in the lateral flow path.

Further scope of the applicability of the present invention will become apparent from the detailed description given hereinafter. However, it should be understood that the detailed description and specific examples, while indicating preferable embodiments of the invention, are given by way of illustration only, since various others will become apparent from this detailed description to those skilled in the art.

BRIEF DESCRIPTION OF THE DRAWINGS

The present invention will become more fully understood from the detailed description given herein below and the accompanying drawings which are given by way of illustration only, and thus are not limitative of the present invention, and wherein.

Figure 1:
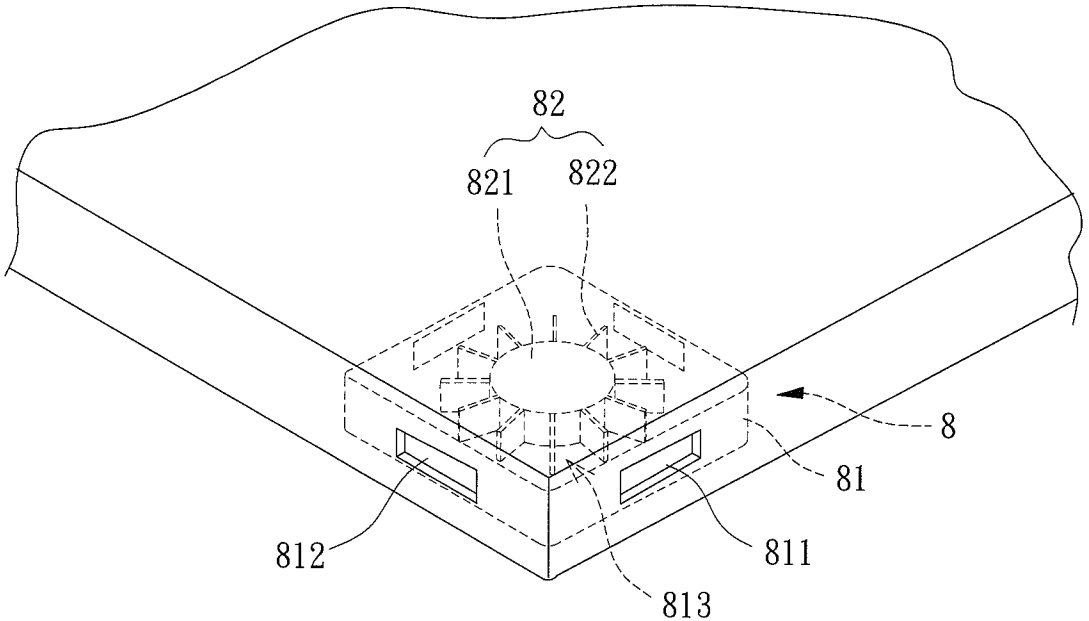
FIG. 1 PRIOR ART
FIG. 1 is a perspective view illustrating a conventional cooling fan.
Figure 2:
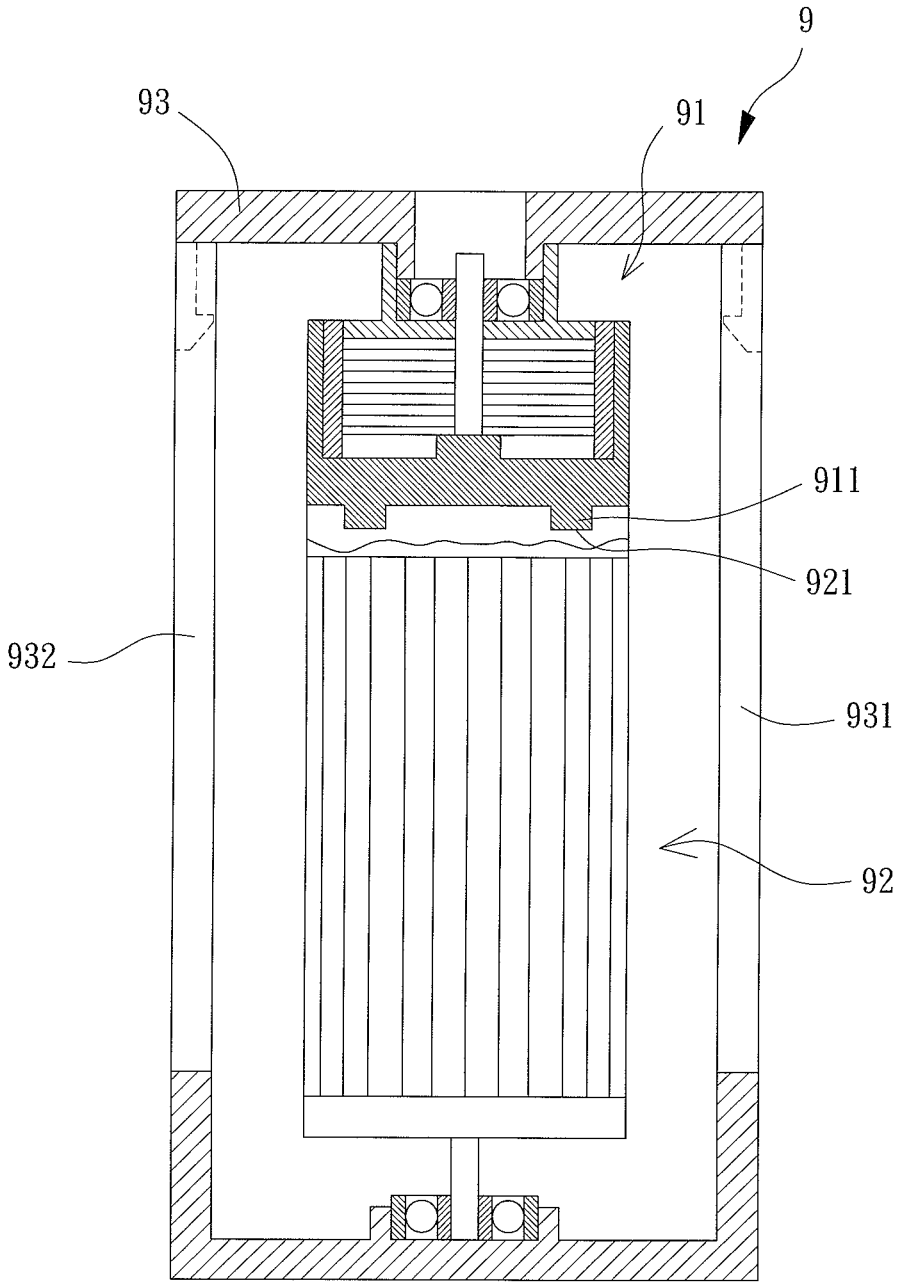
FIG. 2 PRIOR ART
FIG. 2 is a cross sectional view illustrating another conventional cooling fan.

All figures are drawn for ease of explaining the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions conforming to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "end", "portion", "section", "top", "bottom", "axial", "radial", "spacing", and similar terms are used herein, it should be understood that these terms refer only to the structure shown in the drawings as it would appear to a person viewing the drawings, and are utilized only to facilitate describing the invention.

DETAILED DESCRIPTION OF THE INVENTION

Figure 3:
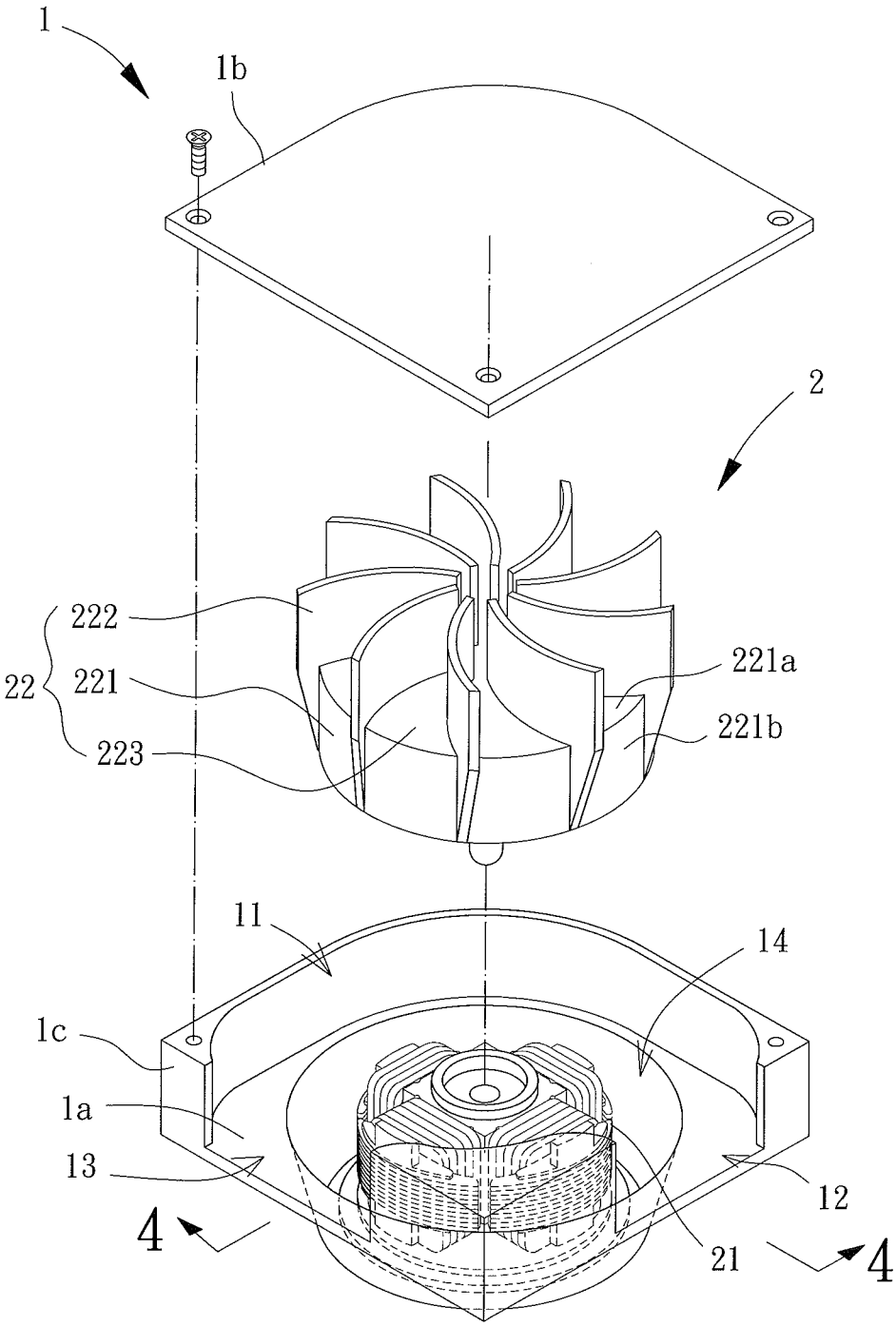
FIG. 3 is an exploded perspective view illustrating a cooling fan in accordance with a first embodiment of the present invention.
Figure 4:
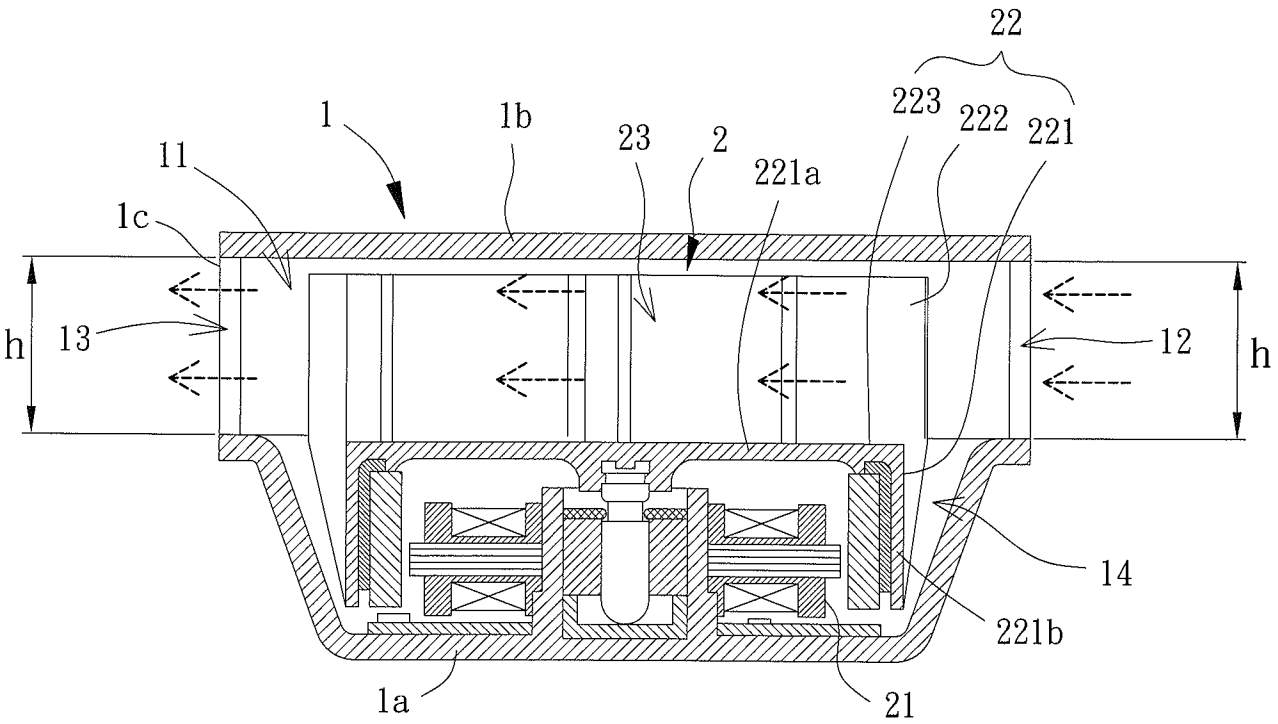
FIG. 4 shows a cross sectional view of the cooling fan in accordance with the first embodiment of the present invention.

Referring to FIGS. 3 and 4, in accordance with a first embodiment of the present invention, the cooling fan comprises a housing 1 and a motor 2. The housing 1 provides a housing structure for driving airflows to flow in a radial direction. The motor 2 is mounted to the inner part of the housing 1.

The housing 1 is any possible hollow housing structure for not only containing the motor 2, but also radially bringing in and bringing out airflows. The housing 1 has a support portion 1*a*, a cover portion 1*b* and a lateral wall portion 1*c*. The support portion 1*a* is opposite to the cover portion 1*b*, and the lateral wall portion 1*c* linking is linked and sandwiched in between the support portion 1*a* and the cover portion 1*b*, with the support portion 1*a*, the cover portion 1*b* and the lateral wall portion 1*c* jointly defining a compartment 11. The lateral wall portion 1*c* has at least one lateral air inlet 12 and at least one lateral air outlet 13, with the at least one lateral air inlet 12 and the at least one lateral air outlet 13 penetrating through both the inner and outer surfaces of the lateral wall portion 1*c*, and communicating with the compartment 11.

In the embodiment of the present invention, the support portion 1*a* is a base; the lateral wall portion 1*c* is a plurality of lateral walls axially extending from a lateral edge of the base; and the cover portion 1*b* is a cover plate mounted to the top edge of the plurality of lateral walls. The compartment 11 is formed between the base and the cover plate, with the plurality of lateral walls surrounding the compartment 11. The lateral air inlet 12 and the lateral air outlet 13 are separately arranged in two of the lateral walls. In the present embodiment as shown in FIG. 3, the lateral air inlet 12 and the lateral air outlet 13 can be formed respectively on two adjacent lateral walls. However, the lateral air inlet 12 and the lateral air outlet 13 can also be arranged in opposite two of the lateral walls. Moreover, the base further has a fillister 14 at the center. The fillister 14 is arranged in the compartment 11 for containing the motor 2 inside the fillister 14.

The motor 2 mounted to the housing 1 comprises a stator 21 and an impeller 22 (also called a rotor), with the stator 21 controlling the rotation of the impeller 22. The impeller 22 has a hub 221 and a plurality of blades 222, with each blade 222 mounted to the hub 221. The hub 221 has a top 223, with the top 223 facing the cover portion 1*b*, and with a space between the top 223 and the cover portion 1*b* delimiting a lateral flow path 23 in the compartment 11. As shown in FIG. 4, the hub 221 is right outside the lateral flow path 23 and each blade 222 is disposed inside the lateral flow path 23. Each blade 222 is preferably mounted to the hub 221.

In the embodiment, the stator 21 of the motor 2 is mounted to the fillister 14 of the housing 1, and the hub 221 of the impeller 22 is rotatably coupled to the stator 21 and disposed in the fillister 14. The hub 221 disposed in the fillister 14 comprises a base plate 221*a* and a peripheral wall 221*b*, with the peripheral wall 221*b* surrounding the base plate 221*a* and received in the fillister 14, and with the top 223 arranged on the base plate 221*a*. Furthermore, based on the design of disposing the plurality of blades 222 inside the lateral flow path 23, the plurality of blades 222 can be mounted to the top 223 of base plate 221*a* with each blade 222 axially extending toward the cover portion 1*b*, and with part of the bottom edge of each blade 222 extending to the peripheral surface of the peripheral wall 221*b* as shown in FIG. 4. Otherwise, the plurality of blades 222 also can be mounted to the top 223 only. In addition, the plurality of blades 222 may be integrally formed on the top 223 of the base plate 221*a*, so that the fabrication of the cooling fan of the present invention can be conveniently achieved.

In practical use, the stator 21 of the motor 2 generates a time-varying magnetic field to propel the rotation of the impeller 22. In this situation, the cooling fan of the present invention is capable of being applied to any possible electric equipment, with the plurality of blades 222 of the impeller 22 driving air currents flowing into the lateral flow path 23 via the lateral air inlet 12 and sequentially flowing out via the lateral air outlet 13, for the sake of effectively dissipating heat when the electric equipment is operating.

The cooling fan of the present invention is characterized by conducting airflows to flow in and flow out the cooling fan in a radial direction of the impeller 22 through the lateral air inlet 12 and the lateral air outlet 13. Accordingly, the cooling fan of the present invention is capable of being applied to any possible electric equipment, and it is unnecessary to be disposed on the heat source. In this situation, the axial height of the electric equipment can be appropriately reduced, and, also the cooling effect of the cooling fan can be effectively promoted, especially for sites near the lateral air outlet 13. More significantly, when air currents are propelled by the impeller 22, inhaled or exhaled to the lateral flow path 23 from the lateral air inlet 12 and the lateral air outlet 13, the air currents will not be disturbed by the hub 221, because the hub 221 is arranged outside the lateral flow path 23 and the plurality of blades 222 is arranged inside the lateral flow path 23. Accordingly, the cooling fan of the embodiment is efficient in preventing air turbulence and advancing the cooling effect.

Figure 5:
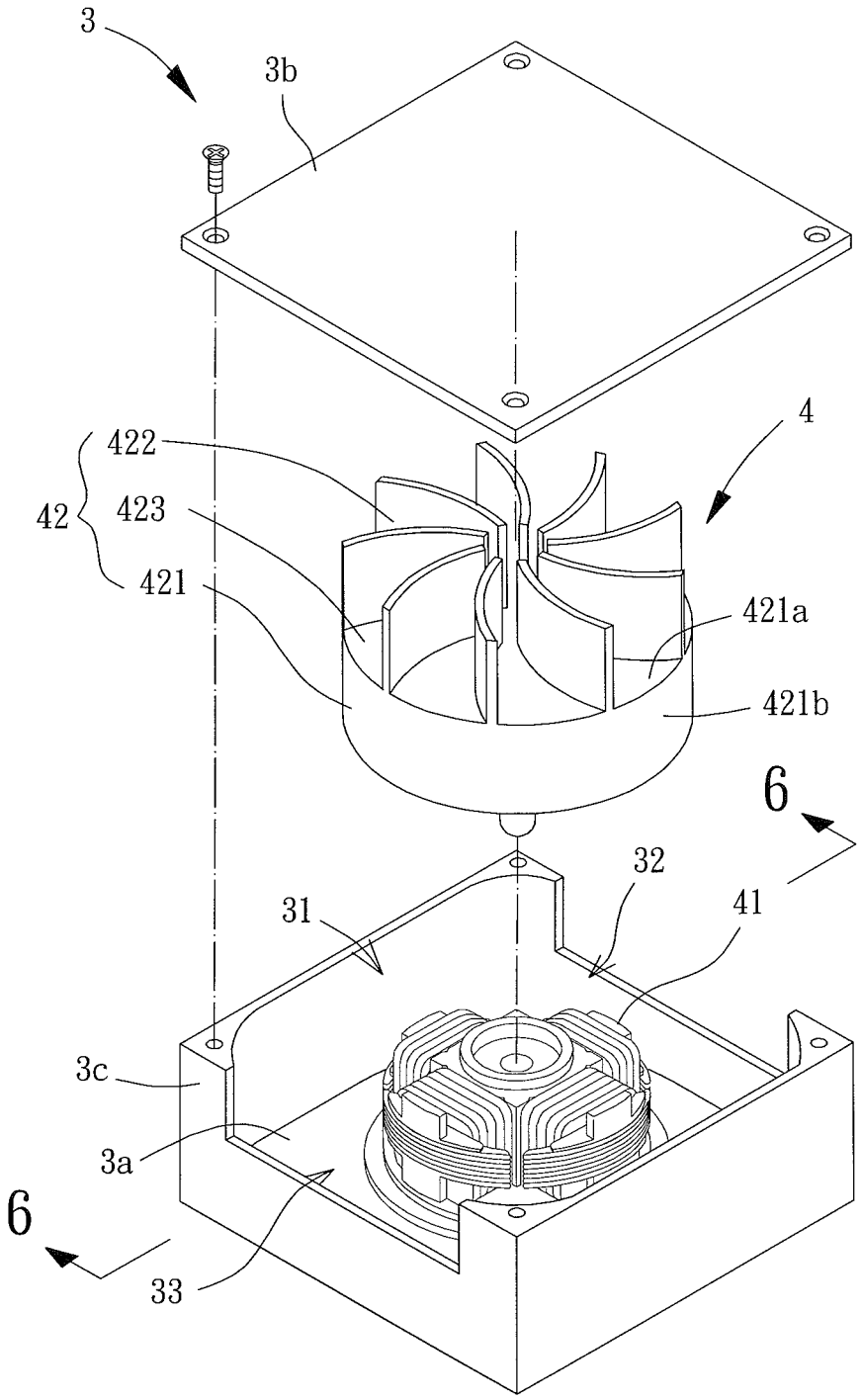
FIG. 5 is an exploded perspective view illustrating the cooling fan in accordance with a second embodiment of the present invention.
Figure 6:
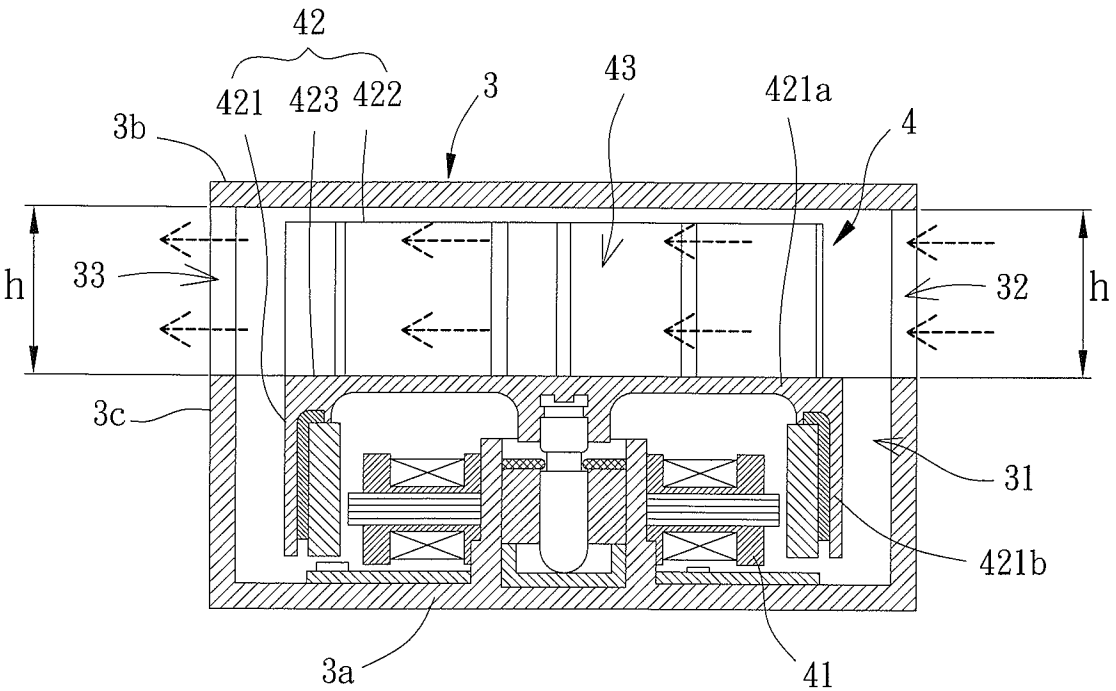
FIG. 6 shows a cross sectional view of the cooling fan in accordance with the second embodiment of the present invention.

Referring to FIGS. 5 and 6, in accordance with a second embodiment of the present invention, the cooling fan also comprises a housing 3 and a motor 4. Similarly to the first embodiment of cooling fan, the housing 3 also has a support portion 3*a*, a cover portion 3*b*, a lateral wall portion 3*c*, compartment 31, lateral air inlet 32, and lateral air outlet 33, while the motor 4 also has a stator 41, an impeller 42, a hub 421, a base plate 421*a*, a peripheral wall 421*b*, a plurality of blades 422 and a top 423, whose structures are approximately the same as that in the first embodiment and will not be given further unnecessary details in the following section.

Similarly, the support portion 3*a* is a base; the lateral wall portion 3*c* is a plurality of lateral walls axially extending from the peripheral edge of the base; and the cover portion 3*b* is a cover plate. It is noted that the major difference between the second and the first embodiments is that: unlike the cooling fan of the first embodiment, the support portion 3*a* does not have any design of the fillister 14 of the first embodiment, and the stator 41 of the motor 4 is directly mounted to the center of the base, that is, the support portion 3*a*. Accordingly, the top 423 and the cover portion 3*b* delimit the lateral flow path 43 in the compartment 31, and the lateral air inlet 32 and the lateral air outlet 33 are arranged on opposite two of the lateral walls, that are the lateral wall portion 3*c*, as shown in FIG. 5. In the preferable embodiment of the present invention, the openings (h) of the lateral air inlet 32 and the lateral air outlet 33 extend between the cover portion 3*b* and the top 423 in the axial direction of the impeller 42, so that the lateral air inlet 32 and the lateral air outlet 33 are in alignment with the plurality of blades respectively, and the hub 421 is positioned within the inside of the lateral wall portion 3*c*. As a result, air currents conducted by the impeller 42 and flowed in from the lateral air inlet 32 will not be disturbed by the hub 421.

Figure 7:
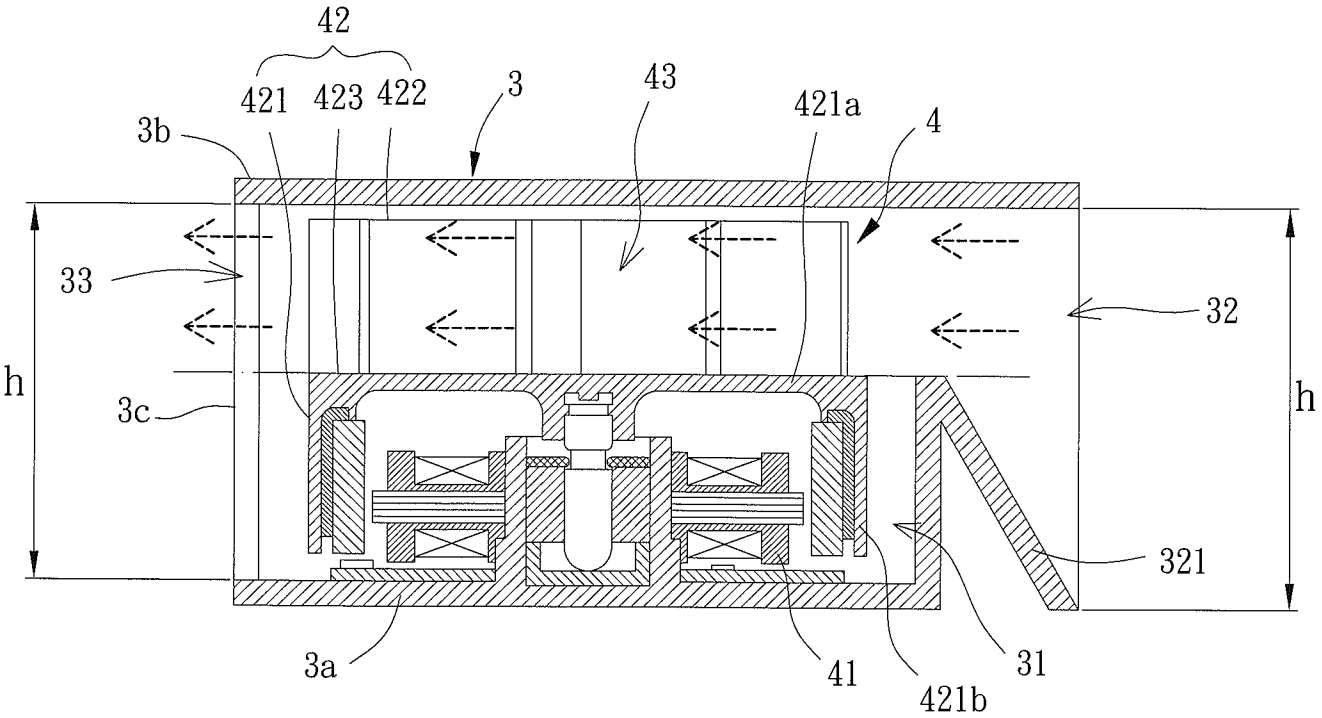
FIG. 7 shows a cross section view of the cooling fan in accordance with the other practice of the second embodiment of the present invention.

Additionally, the above description of the opening (h) of the lateral air inlet 32 and the lateral air outlet 33 is only related to the preferable embodiment of the present invention. With reference to FIG. 7, the opening (h) of the lateral air outlet 33 can further extend from the support portion 3*a* to the cover portion 3*b* in the axial direction of the impeller 42, in order to effectively bring out airflows. Also, the opening (h) of the lateral air inlet 32 also can extend from the support portion 3*a* to the cover portion 3*b* in the axial direction of the impeller 42, and forms an air-guiding portion 321 with a wide-caliber in shape, to increase airflows that flow in. In this situation, the impeller 42 can conduct air currents more smoothly to flow into the lateral flow path 43.

Figure 8:
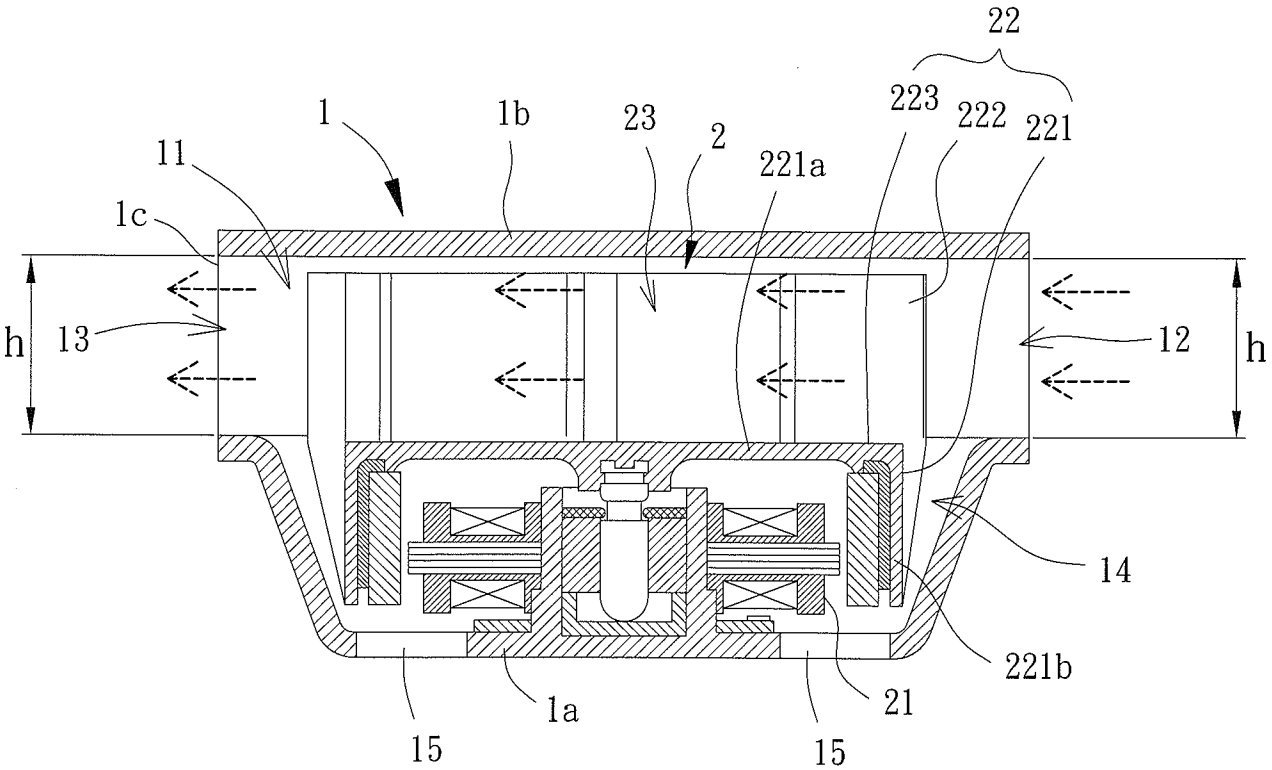
FIG. 8 shows a cross section view of a cooling fan of the present invention, which has a support portion with through-pores.

Furthermore, FIG. 8 is a modification of the support portion 1*a* in the cooling fan of the first embodiment, and it is also adaptable to the cooling fan of the second embodiment in the present invention. The support portion 1*a*, of the housing 1 further has at least one through-pore 15 to allow the circulating of air currents. In this way, when the motor 2 is mounted to the compartment 11 of the housing 1, the through-pore 15 of the support portion 1*a* bring in air currents for circulation, which advances the air-circulation in the cooling fan, as well as the heat-dissipation of the motor 2.

Figure 9:
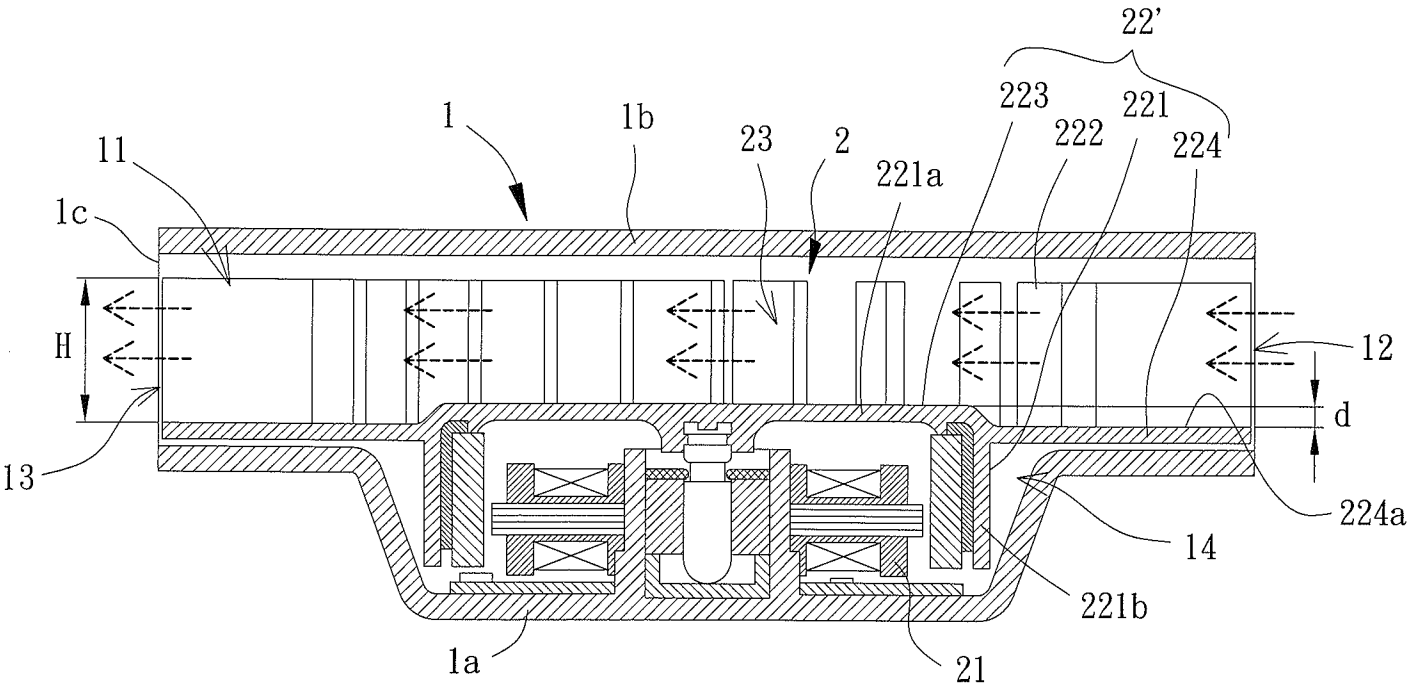
FIG. 9 shows a cross section view of a cooling fan of the present invention, which has an impeller with an annular plate.

Moreover, referring to FIG. 9, a modification of the impeller of the motor 2, and can also be adapted to the cooling fan of the second embodiment in the present invention. This modified impeller 22' also has the hub 221, blades 222, and top 223, and further provides an annular plate 224 radially extending from an outer periphery of the hub 221, with the blades 222 mounted on an upper surface 224*a* of the annular plate 224 and axially extending towards the cover portion 1*b*. Besides, in an axial direction of the impeller 22', the upper surface 224*a* of the annular plate 224, which faces the cover portion 1*b*, aligns with the top 223 or has a level difference "d" relative to the top 223. When the upper surface 224*a* aligns with the top 223, airflow guided by the blades 222 can smoothly flow without being blocked by the hub 221. On the other hand, when the upper surface 224*a* has the level difference "d" relative to the top 223, an increased area of the blades 222 due to the level difference "d" can increase airflows flowing into and out of the housing 1. Furthermore, the level difference "d" preferably matches the following equation to efficiently lower the blocking affect caused by this level difference "d,"

$$\text{leveldifference“d”} \leq 0.5\text{H}.$$

In the above equation, the "H" represents an axial length of the blades 222 in the axial direction of the impeller 22'.

Figure 10:
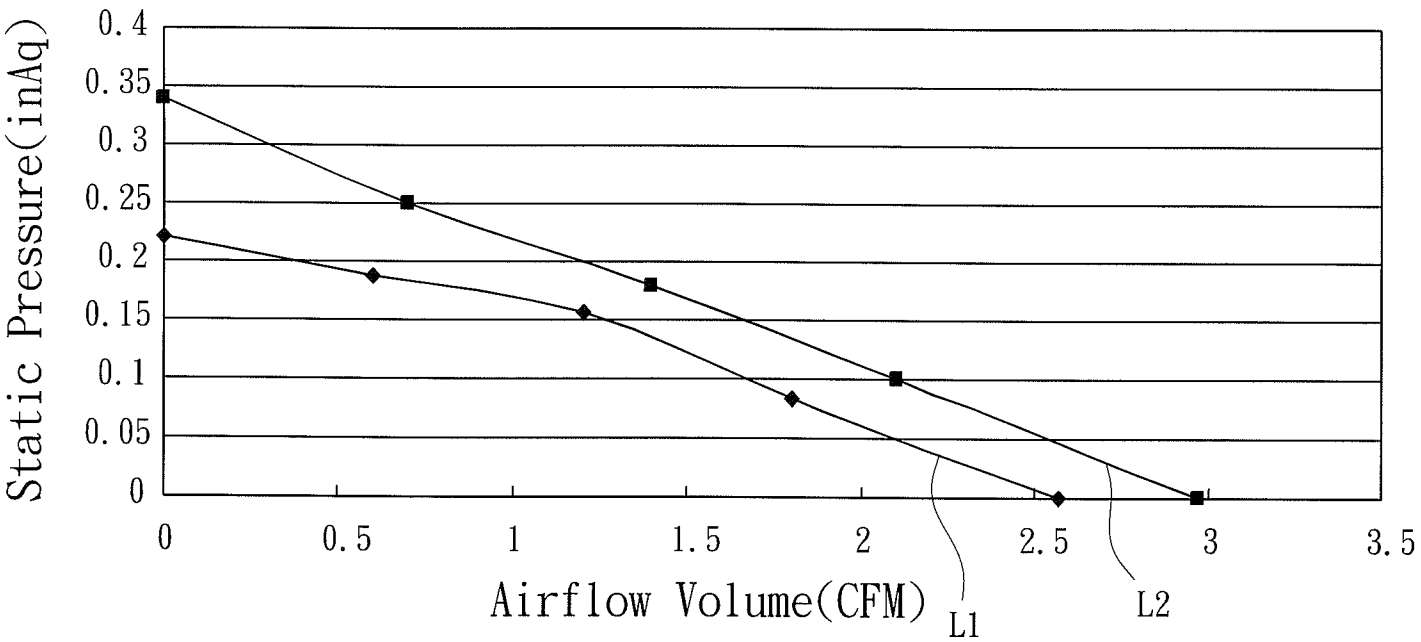
FIG. 10 shows a performance chart illustrating a cooling fan with different level differences.

Referring to FIG. 10, a performance chart of the impeller 22' is shown. In this performance chart, line L1 illustrates a "static pressure" to "airflow volume" curve with the level difference "d" larger than 0.5H, while line L2 illustrates another "static pressure" to "airflow volume" curve with the level difference "d" smaller or equal to 0.5H. In accordance with this performance chart, an impeller 22' with the level difference "d" smaller or equal to 0.5H can apparently raise the static pressure and airflow volume at the same time.

In summary, with the design of the lateral flow path 23, 43 of the cooling fan in the present invention, the cooling fan is sufficient in preventing air turbulence when air currents are propelled by the impeller 22, 22', 42 and circulating into the lateral flow path 23, 43 from the lateral air inlet 12, 32 to the lateral air outlet 13, 33. Therefore, the cooling effect of the present invention can be dramatically promoted.

Thus, since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A cooling fan comprising:

a housing including a support portion, a cover portion and a lateral wall portion, with the lateral wall portion disposed between the cover portion and the support portion, with the lateral wall portion, the support portion and the cover portion defining a compartment, and with the lateral wall portion having at least one lateral air inlet and at least one lateral air outlet penetrating through the lateral wall portion and communicating with the compartment; and a motor mounted inside the compartment of the housing and containing a stator and an impeller, with the impeller rotatable mounted about a rotatable axis to the stator, with the impeller further containing a hub with a top and a plurality of blades with the top facing the cover portion, wherein the top is intermediate the cover portion and the stator, is parallel to the cover portion, and is perpendicular to the rotatable axis of the impeller, with each blade mounted to the top of the hub and axially extending from the top toward the cover portion, with the at least one lateral air inlet and the at least one lateral air outlet in the lateral wall extending to the cover portion, with the top and the cover portion delimiting a lateral flow path parallel to the cover portion in the compartment from the at least one lateral air inlet through the at least one lateral air outlet, with the at least one lateral air inlet and the at least one lateral air outlet aligned in a plane perpendicular to the rotatable axis, and with each blade being contained in the lateral flow path, with the motor mounted outside of the lateral flow path.

2. The cooling fan as defined in claim 1, wherein the opening of the lateral air inlet extends between the cover portion and the top of the hub in the axial direction of the impeller.

3. The cooling fan as defined in claim 1, wherein the opening of the lateral air outlet extends between the cover portion and the top of the hub in the axial direction of the impeller.

4. The cooling fan as defined in claim 2, with the lateral air inlet in alignment with the plurality of blades mounted on the top of the impeller.

5. The cooling fan as defined in claim 3, with the lateral air outlet in alignment with the plurality of blades mounted on the top of the impeller.

6. The cooling fan as defined in claim 1, wherein the support portion is a fillister arranged in the compartment, with the fillister connecting with the stator of the motor to contain the hub of the impeller.

7. The cooling fan as defined in claim 1, wherein the lateral air inlet forms an air-guiding portion.

8. The cooling fan as defined in claim 1, wherein the support portion is a base; the lateral wall portion is a plurality of lateral walls axially extending from a lateral edge of the base; and the cover portion is a cover plate, with the cover plate mounted to the plurality of lateral walls, with the cover plate and the base defining the compartment, and with the lateral air inlet and lateral air outlet respectively arranged on two adjacent lateral walls.

9. The cooling fan as defined in claim 1, wherein the support portion is a base; the lateral wall portion is a plurality of lateral walls axially extending from a lateral edge of the base; and the cover portion is a cover plate, with the cover plate mounted to the plurality of lateral walls, with the cover plate and the base defining the compartment, and with the lateral air inlet and lateral air outlet respectively arranged on two opposite lateral walls.

10. The cooling fan as defined in claim 1, wherein the plurality of blades are integrally formed on the hub.

11. The cooling fan as defined in claim 1, wherein the support portion of the housing has at least one through-pore.

12. The cooling fan as defined in claim 1, wherein an annular plate radially extends from an outer periphery of the hub parallel to the top and the cover portion, and perpendicular to the rotatable axis of the impeller, and wherein the blades are mounted on the annular plate and extending towards the cover portion.

13. The cooling fan as defined in claim 12, wherein an upper surface of the annular plate faces the cover portion, and wherein the upper surface has a level difference relative to the top of the hub.

14. The cooling fan as defined in claim 13, wherein the level difference is smaller or equal to half of an axial length of the plurality of blades.

15. The cooling fan as defined in claim 12, wherein an upper surface of the annular plate faces the cover portion, and wherein the upper surface aligns with the top of the hub.

16. The cooling fan as defined in claim 1, wherein the hub further includes an annular wall extending axially from the top, and wherein each blade extends radially from the annular wall.

* * * * *